US008348750B2

(12) United States Patent
Jordan et al.

(10) Patent No.: US 8,348,750 B2
(45) Date of Patent: Jan. 8, 2013

(54) SYSTEM FOR ELECTRONIC GAME PROMOTION

(75) Inventors: R. Jeffrey Jordan, Las Vegas, NV (US); Scott A. Boyd, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 12/616,674

(22) Filed: Nov. 11, 2009

(65) Prior Publication Data

US 2010/0056264 A1 Mar. 4, 2010

Related U.S. Application Data

(63) Continuation of application No. 10/308,768, filed on Dec. 2, 2002, now abandoned.

(60) Provisional application No. 60/410,545, filed on Sep. 13, 2002.

(51) Int. Cl.
*A63F 9/00* (2006.01)

(52) U.S. Cl. ..... 463/25; 463/16; 463/17; 463/18; 463/19; 463/20; 463/40; 463/41; 463/42

(58) Field of Classification Search ..... 463/25, 463/16–20, 40–42
See application file for complete search history.

(56) References Cited

U.S. PATENT DOCUMENTS

| | | | |
|---|---|---|---|
| 4,258,838 | A | 3/1981 | Rockola et al. |
| 4,689,742 | A | 8/1987 | Troy et al. |
| 5,231,568 | A | 7/1993 | Cohen et al. |
| 5,265,874 | A | 11/1993 | Dickinson et al. |
| 5,290,033 | A | 3/1994 | Bittner et al. |
| 5,487,544 | A | 1/1996 | Clapper, Jr. |
| 5,489,096 | A | 2/1996 | Aron |
| 5,551,692 | A | 9/1996 | Pettit et al. |
| 5,609,337 | A | 3/1997 | Clapper, Jr. |
| 5,645,485 | A | 7/1997 | Clapper, Jr. |
| 5,647,592 | A | 7/1997 | Gerow |
| 5,655,961 | A | 8/1997 | Acres et al. |
| 5,743,798 | A | 4/1998 | Adams et al. |
| 5,749,784 | A | 5/1998 | Clapper, Jr. |

(Continued)

FOREIGN PATENT DOCUMENTS

AU 200214780 3/2002

(Continued)

OTHER PUBLICATIONS

U.S. Office Action dated Nov. 29, 2005 issued in U.S. Appl. No. 11/081,349.

(Continued)

*Primary Examiner* — Dmitry Suhol
*Assistant Examiner* — David Duffy
(74) *Attorney, Agent, or Firm* — Weaver Austin Villeneuve & Sampson LLP

(57) ABSTRACT

A printer on a networked gaming device can be controlled by the network to generate awards. The printer can operate as both a typical printer in a gaming device and as a printer for the gaming network, or separate printers can be installed in the gaming device. If the particular player has identified himself or herself to the gaming network, then the gaming system has a very high probability that it is communicating to a known player. Therefore, the printer operates as a direct communication conduit to a player. Additionally, previously issued awards can be redeemed by a validator coupled to the gaming network.

15 Claims, 9 Drawing Sheets

U.S. PATENT DOCUMENTS

| | | | | |
|---|---|---|---|---|
| 5,752,882 | A | 5/1998 | Acres et al. | |
| 5,816,918 | A | 10/1998 | Kelly et al. | |
| 5,820,459 | A | 10/1998 | Acres et al. | |
| 5,836,817 | A | 11/1998 | Acres et al. | |
| 5,876,284 | A | 3/1999 | Acres et al. | |
| 5,927,541 | A | 7/1999 | Stoken et al. | |
| 5,928,082 | A | 7/1999 | Clapper, Jr. | |
| 5,967,892 | A | 10/1999 | Shoemaker, Jr. | |
| 6,048,269 | A | 4/2000 | Burns et al. | |
| 6,113,098 | A * | 9/2000 | Adams | 463/17 |
| 6,135,884 | A | 10/2000 | Hedrick et al. | |
| 6,146,273 | A | 11/2000 | Olsen | |
| 6,210,277 | B1 | 4/2001 | Stefan | |
| 6,231,445 | B1 | 5/2001 | Acres | |
| 6,244,958 | B1 | 6/2001 | Acres | |
| 6,254,483 | B1 | 7/2001 | Acres | |
| 6,257,981 | B1 | 7/2001 | Acres et al. | |
| 6,267,671 | B1 | 7/2001 | Hogan | |
| 6,319,125 | B1 | 11/2001 | Acres | |
| 6,340,331 | B1 | 1/2002 | Saunders | |
| 6,358,149 | B1 | 3/2002 | Schneider et al. | |
| 6,364,768 | B1 | 4/2002 | Acres et al. | |
| 6,371,852 | B1 | 4/2002 | Acres | |
| 6,375,567 | B1 | 4/2002 | Acres | |
| 6,375,569 | B1 | 4/2002 | Acres | |
| 6,394,907 | B1 | 5/2002 | Rowe | |
| 6,431,983 | B2 | 8/2002 | Acres | |
| 6,471,590 | B2 | 10/2002 | Saunders | |
| 6,511,377 | B1 | 1/2003 | Weiss | |
| 6,547,664 | B2 | 4/2003 | Saunders | |
| 6,558,256 | B1 | 5/2003 | Saunders | |
| 6,582,310 | B1 | 6/2003 | Walker et al. | |
| 6,623,357 | B2 | 9/2003 | Chowdhury | |
| 6,645,078 | B1 | 11/2003 | Mattice | |
| 6,729,957 | B2 | 5/2004 | Burns et al. | |
| 6,896,616 | B2 | 5/2005 | Weiss | |
| 7,008,320 | B2 | 3/2006 | Rowe et al. | |
| 7,070,501 | B2 * | 7/2006 | Cormack et al. | 463/25 |
| 7,594,855 | B2 | 9/2009 | Meyerhofer | |
| 2001/0027126 | A1 | 10/2001 | Saunders | |
| 2002/0093136 | A1 | 7/2002 | Moody | |
| 2002/0098888 | A1 | 7/2002 | Rowe et al. | |
| 2002/0128059 | A1 | 9/2002 | Baltz et al. | |
| 2003/0013515 | A1 | 1/2003 | Rowe et al. | |
| 2003/0036425 | A1 | 2/2003 | Kaminkow et al. | |
| 2003/0078094 | A1 | 4/2003 | Gatto et al. | |
| 2003/0087691 | A1 | 5/2003 | Kiely et al. | |
| 2003/0157977 | A1 | 8/2003 | Thomas et al. | |
| 2003/0162591 | A1 | 8/2003 | Nguyen et al. | |
| 2003/0186734 | A1 | 10/2003 | LeMay et al. | |
| 2003/0186739 | A1 | 10/2003 | Paulsen et al. | |
| 2003/0217329 | A1 | 11/2003 | Good | |
| 2004/0043813 | A1 | 3/2004 | Chamberlain et al. | |
| 2004/0053681 | A1 | 3/2004 | Jordan et al. | |
| 2004/0095604 | A1 | 5/2004 | Meyerhofer | |
| 2004/0254011 | A1 | 12/2004 | Muskin | |
| 2006/0039733 | A1 | 2/2006 | Meyerhofer | |
| 2008/0214292 | A1 | 9/2008 | Bryant et al. | |

FOREIGN PATENT DOCUMENTS

| | | |
|---|---|---|
| AU | 2001288777 | 3/2002 |
| AU | 2002320266 | 1/2003 |
| AU | 2002345797 | 3/2003 |
| CA | 2 453 448 | 1/2003 |
| EP | 1 293 943 | 9/2003 |
| GB | 2 208 737 | 4/1989 |
| GB | 2 406 951 | 4/2002 |
| GB | 2 386 733 | 9/2003 |
| GB | 2 430 532 | 3/2008 |
| WO | WO 00/16864 | 3/2000 |
| WO | WO 01/32281 | 5/2001 |
| WO | WO 02/17251 | 2/2002 |
| WO | WO 02/23491 | 3/2002 |
| WO | WO 02/32520 | 4/2002 |
| WO | WO 02/43019 | 5/2002 |
| WO | WO 02/068071 | 9/2002 |
| WO | WO 03/003319 | 1/2003 |
| WO | WO 03/013678 | 2/2003 |
| WO | WO 03/035196 | 5/2003 |
| WO | WO 03/075203 | 9/2003 |
| WO | WO 2004/013820 | 2/2004 |
| WO | WO 2004/021290 | 3/2004 |
| WO | WO 2005/089374 | 9/2005 |

OTHER PUBLICATIONS

U.S. Office Action dated Jun. 28, 2006 issued in U.S. Appl. No. 11/081,349.

U.S. Final Office dated Feb. 15, 2007 issued in U.S. Appl. No. 11/081,349.

U.S. Final Office dated Aug. 15, 2007 issued in U.S. Appl. No. 11/081,349.

U.S. Interview Summary dated Feb. 1, 2008 issued in U.S. Appl. No. 11/081,349.

U.S. Office Action dated Apr. 3, 2008 issued in U.S. Appl. No. 11/081,349.

U.S. Final Office Action dated Dec. 26, 2008 issued in U.S. Appl. No. 11/081,349.

U.S. Office Action dated Jul. 14, 2009 issued in U.S. Appl. No. 11/081,349.

International Search Report and Written Opinion dated Feb. 14, 2006 issued in PCT/US2005/008742.

Australian Examination Report dated Jan. 28, 2009 issued in AU2003241642.

Canadian Office Action dated Sep. 22, 2006 issued in 2,438,004.

Canadian Office Action dated May 27, 2008 issued in 2,438,004.

United Kingdom Search Report dated Nov. 20, 2003 issued in 0320556.4.

United Kingdom Examination Report dated Aug. 11, 2005 issued in 0320556.4.

United Kingdom Combined Search and Examination Report dated Jan. 27, 2006 issued in 0525353.9.

United Kingdom Combined Search and Examination Report dated Feb. 16, 2007 issued in 0619063.1.

United Kingdom Combined Search and Examination Report dated Feb. 15, 2007 issued in 0619062.3.

United Kingdom Exam Report dated Mar. 13, 2007 issued in 0619062.3.

United Kingdom Combined Search and Examination Report dated Feb. 16, 2007 issued in 0619061.5.

*Brandstetter et al.* v. *Bally Gaming Inc. et al.*, Case No. A571641, Complaint filed Sep. 15, 2008.

*Brandstetter et al.* v. *Bally Gaming Inc. et al.*, Case No. A571641, Defendants IGT et al's. Answer to Complaint, filed Oct. 15, 2008.

*Brandstetter et al.* v. *Bally Gaming Inc. et al.* Case No. A571641, Defendants Bally Gaming, Inc's Motion to Dismiss; Motion for More Definite Statement, filed Nov. 17, 2008.

*Brandstetter et al.* v. *Bally Gaming Inc. et al.*, Case No. A571641C, Opposition to Bally Gaming, Inc.'s Motion to Dismiss; Motion for More Definite Statement, filed Nov. 25, 2008.

*Brandstetter et al.* v. *Bally Gaming Inc. et al* . . . , Case No. A571641, Opposition to Scott Boyd's Motion to Dismis, filed Dec. 10, 2008.

*Brandstetter et al.* v. *Bally Gaming Inc. et al.*, Case No. A571641, Affidavit of Michael Longmeyer, filed Dec. 11, 2008.

*Brandstetter et al.* v. *Bally Gaming Inc. et al.*, Case No. A571641, Defendants IGT and Acres Gaming, Inc.'s Motion for Summary Judgment, filed Dec. 12, 2008.

*Brandstetter et al.* v. *Bally Gaming Inc. et al.*, Case No. A571641, Affidavit of Scott Boyd, filed Dec. 12, 2008.

*Brandstetter et al.* v. *Bally Gaming Inc., et al.*, Case No. A571641, Bally Gaming Inc.'s Reply in Support of Motion to Dismiss and for More Definite Statement, filed Dec. 23, 2008.

*Brandstetter et al.* v. *Bally Gaming Inc., et al.*, Case No. A571641, Errata to Motion for Summary Judgment, filed Jan. 8, 2009.

*Brandstetter et al.* v. *Bally Gaming Inc. et al.*., Case No. A571641, Opposition to Defendants' IGT and Acres Gaming, Inc.'s Motion for Summary Judgment filed Jan. 9, 2009.

*Brandstetter et al.* v. *Bally Gaming Inc. et al.*, Case No. A571641, Reply to Plaintiffs' Opposition to Defendants IGT and Acres Gaming, Inc.'s Motion for Summary Judgment, filed Jan. 13, 2009.

*Brandstetter et al.* v. *Bally Gaming Inc. et al.*, Case No. A571641, Supplemental Exhibit J to Reply to Plaintiffs' Oppositin to Defendants IGT and Acres Gaming, Inc.'s Motion for Summary Judgment, filed Jan. 14, 2009.
*Brandstetter et al.* v. *Bally Gaming Inc. et al.*, Case No. A571641, First Amended Complaint with Exhibit A: filed Under Searl Pursuant to Court Order, filed Jan. 30, 2009.
*Brandstetter et al.* v. *Bally Gaming Inc. et al.*, Case No. A571641, Defendant Bally's NRCP 16.1 Early Case Conference Report, dated Feb. 27, 2009.
*Brandstetter et al.* v. *Bally Gaming Inc. et al.*, Case No. A571641, Defendants' Case Conference Report, dated Mar. 30, 2009.
*Brandstetter et al.* v. *Bally Gaming Inc. et al.*, Case No. A571641, Findings of Fact, Conclusions of Law & Judgment, filed Jun. 11, 2009.
U.S. Office Action dated Mar. 9, 2006 issued in U.S. Appl. No. 10/308,768.
U.S. Final Office Action dated Nov. 2, 2006 issued in U.S. Appl. No. 10/308,768.
U.S. Office Action dated Sep. 19, 2007 issued in U.S. Appl. No. 10/308,768.
U.S. Final Office Action dated Mar. 18, 2008 issued in U.S. Appl. No. 10/308,768.
U.S. Final Office Action dated Aug. 14, 2008 issued in U.S. Appl. No. 10/308,768.
U.S. Office Action dated Feb. 2, 2009 issued in U.S. Appl. No. 10/308,768.
U.S. Final Office Action dated Jul. 7, 2009 issued in U.S. Appl. No. 10/308,768.
U.S. Office Action dated Dec. 8, 2009 issued in U.S. Appl. No. 10/308,768.
Australian Office Action dated Feb. 5, 2010 issued in 2003241642.
Canadian Office Action dated Jul. 12, 2010 issued in 2,438,004.
U.S. Office Action dated Aug. 5, 2010 issued in U.S. Appl. No. 12/687,802.
U.S. Final Office Action dated Dec. 17, 2010 issued in U.S. Appl. No. 12/687,802.
U.S. Office Action dated May 2, 2012 issued in U.S. Appl. No. 12/687,802.
U.S. Final Office Action dated Sep. 19, 2011 issued in U.S. Appl. No. 12/687,802.
Australian First Examination Report dated Aug. 31, 2011 issued in 2011200264.
Vinson, B., "Ask Barney! An Insider's Guide to Las Vegas," Bonus Books, Inc., Published Apr. 25, 2002, pp. 49-51.

* cited by examiner

SYSTEM FOR ELECTRONIC GAME PROMOTION

RELATED APPLICATIONS

This application is a continuation of and claims priority to U.S. patent application Ser. No. 10/308,768, filed on Dec. 2, 2002, titled "SYSTEM FOR ELECTRONIC GAME PROMOTION," by Jordan et al., which claims priority to U.S. Provisional Patent Application No. 60/410,545, filed on Sep. 13, 2002, titled "SYSTEM FOR ELECTRONIC GAME PROMOTION," by Jordan et al., both of which are incorporated herein by reference in their entirety and for all purposes.

TECHNICAL FIELD

This disclosure relates to networked gaming devices, and, more specifically, to a system for promoting player loyalty to a gaming system by generating and redeeming promotional tickets.

BACKGROUND

Gaming machines are popular entertainment devices. Present gaming machines provide an opportunity for a user to play a variety of popular games on the machines, such as fruit machines or slot-type games, video adaptations of standard card games like poker and blackjack, and many other types of games.

Modem gaming machines are coupled to a gaming network that performs many management type functions, such as accounting, game tracking, player tracking, and bonusing. Players who identify themselves to the gaming network accumulate bonus points by playing the games. Accumulated bonus points can be later converted into machine credits or cash, thus providing bonusing systems encourages players to identify themselves to the gaming network.

Present gaming networks communicate directly with either an identified or non-identified player by displaying messages on a video display mounted to the gaming machine itself. The player can input text and answer network-generated questions by using a keyboard that is mounted to the gaming machine near the display, or by making selections on a touch-screen display.

Additionally, a player can retrieve information about his or her bonus account by communicating with a casino employee, who in turn can access the gaming network. Generally, the employee can access portions of the gaming network quickly by using a computer terminal that has a secure login. For security, players cannot access the gaming network directly, other than at the game itself.

Although casinos try to staff customer service booths with enough employees to attend to all players' needs, it is difficult to accurately project how many employees will be needed at any given time. Having too many employees causes a casino to incur high labor costs, and reduces casino profits. Having too few employees can lead to customer frustration by having to wait for available employees to help the player. This can lead to the player not returning to the casino, also reducing casino profits.

Another way casinos lose business is by not being able to monitor and interact with players as they are playing. For instance, casinos generally have a slow period between 4:00 and 6:00 pm, that is, over the period when many people eat dinner. During these times casino patrons are preparing for or are eating dinner, and consequently, fewer players are playing the machines in the casino. Sometimes, as players are readying to leave for dinner, casino employees walk around the casino floor and offer food coupons to the players that are only valid beginning several hours from the present time. The casino offers the coupons in an effort to entice the player to remain at the game through the typically slow period. Again, because making such offers requires personnel actively monitoring players and then issuing the coupons to players, labor costs tend to limit the ability of casinos to provide such services.

Embodiments of the invention address these and other deficiencies in casino gaming systems.

BRIEF DESCRIPTION OF THE DRAWINGS

The description may be best understood by reading the disclosure with reference to the accompanying drawings.

DETAILED DESCRIPTION

Figure 1:
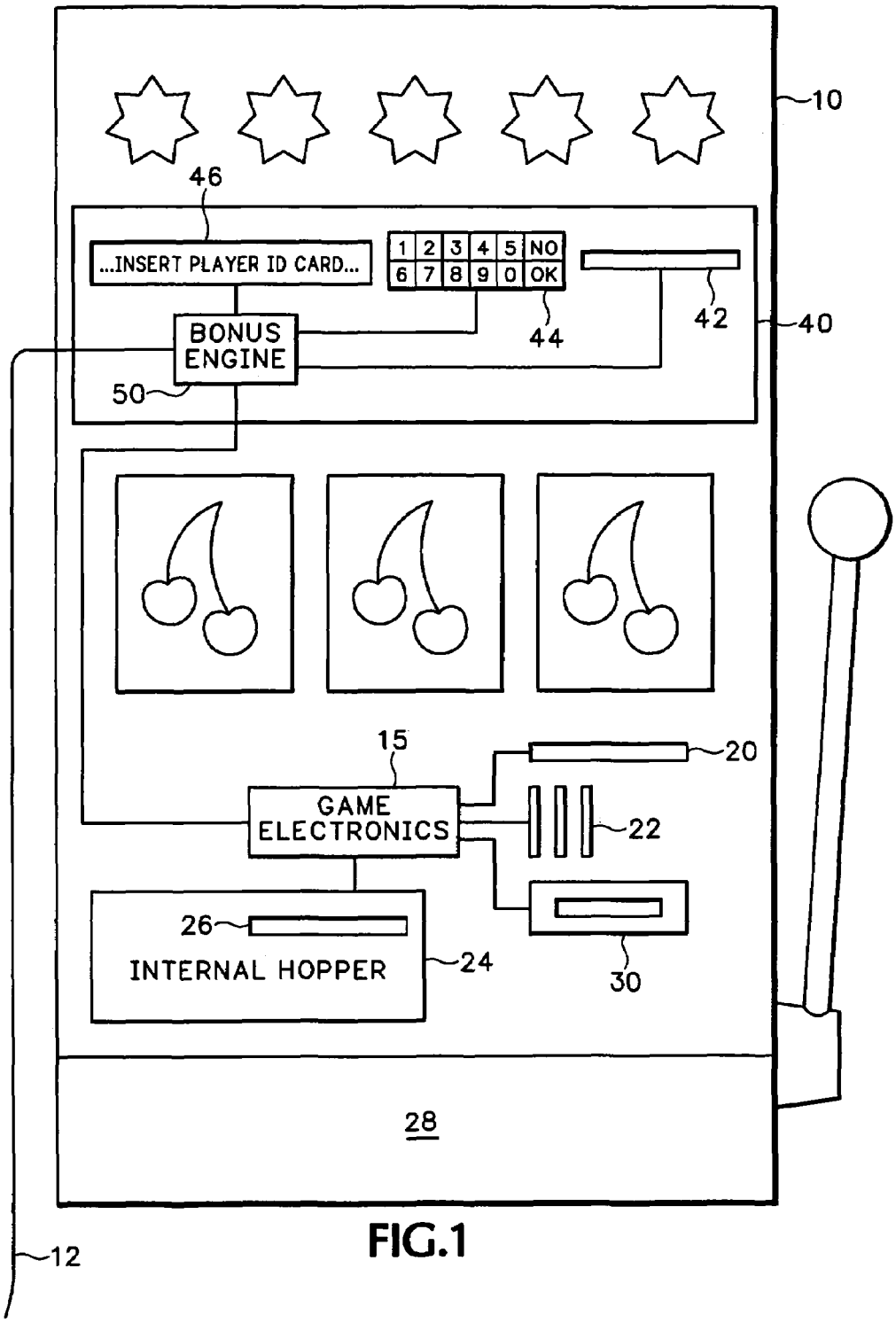
FIG. 1 is a diagram showing a gaming device including a ticket printer according to embodiments of the invention.

Embodiments of the invention include a player tracking system that communicates to a player in various ways, one of which is via a ticket printer. The ticket printer can be embodied either as a standalone system printer separate from the gaming device, or could be embodied by performing special ticket printing functions on a standard game printer already found in a typical gaming device.

If the particular player has identified himself or herself to the gaming network, then the player tracking system has a very high probability that it is communicating to a particular player. Therefore, the ticket printer operates as a direct communication conduit to a player.

The ticket printer, whether it is operating on a standard game printer or as a separate system printer, is controlled by functions and processes running either at the gaming device itself, or the functions and processes may be running on a promotion, bonus, or other server and communicated to the particular printer over the gaming network, as described in detail below.

The printing functions that cause the system tickets to be printed can operate according to a number of factors, all of which can be specifically tailored depending on various data inputs. For instance, the data input could come from the player's identification, various data about the current game, such as the number of bonuses or lack of winning. The length of a current gaming session could also be considered. Additionally, the data could come from historical records of the specific player, a subset of players, or data about all the players historically or even those currently on the game network. Still further, the input factors to cause printed tickets may include time of day, day of week, month of year, etc. Special promotions could also use the ticket printer to directly communicate with players. Functions can include any or all of this information in a decision to cause the printer to communicate directly with the player by printing a particular ticket. Details of the functions and the data events that trigger generating the system ticket are discussed in detail below. Although the object printed by the ticket printer will be referred to herein as a ticket, the object can be printed on almost any type of substrate, have almost any size, and contain almost any type of writing on it.

Embodiments of the invention also extend to redemption of promotional tickets and other promotional items. Once a player has a promotional item, the player may redeem it by inserting it into the validator of the gaming device. The validator communicates to a central data system to determine if the player is eligible to receive the promotional item. If so, the validator accepts the item and a benefit is provided to the player, such as additional machine credits or bonus points.

As used in this description, a pay table of a gaming device is the standard winnings paid or credited to the player by the device itself. A bonus award is machine credits either credited to a machine or credited to a player account by a bonus system, or bonus points credited to a player account by the bonus system. A system award is a benefit that is paid or credited to a player of a gaming device that is not based on either the pay table of the gaming device or a bonus award. Examples of a system award include a complementary meal or show ticket, a drawing ticket, or bonus points or machine credits not based on either a gaming device pay table or a bonus award.

Turning to FIG. 1, a gaming device 10 according to an embodiment of the invention is shown. The gaming device 10 includes a bill acceptor 20 that accepts and validates bills, tickets or vouchers. Bill validators operate by scanning barcodes or other identifying features on tickets or vouchers, and by examining printing or other security features on paper currency to determine authenticity. Bill validators are well known in the gaming arts.

The gaming device 10 also includes one or more coin slots 22 for accepting coins or tokens. An internal hopper 24 temporarily stores coins or tokens for later payment to the player through a payout bin 28, if the player chooses to cash out in such a manner. Bills can also be stored in a separate hopper, and dispensed to the player through the bill acceptor 20 or through another bill slot 26 in the hopper 24, similar to an ATM machine.

A set of game electronics 15 manages the central operations of the gaming device 10. For example, the game electronics 15 counts the monetary value input into the game 10, and tracks and stores values for this and other data items. The game electronics 15 also control the game play of the gaming device 10, such as by accepting user input from various buttons (not shown) to cause credits to be wagered, as well as cause motors to spin the game wheels, speakers to generate sound, and circuits to generate lights or video signals. The game electronics 15 may be a main board that interfaces with various controller boards that control specific functions in the gaming device 10, or may control the various devices directly.

One of the items controlled by the game electronics 15 is an internal game printer 30. The game printer 30 can be of any type known in the art, such as impact, inkjet, thermal, laser, and can be a color printer or standard black and white. Even if the game printer 30 is only capable of printing in a single color, cardstock or paper used by the printer could be preprinted in color.

The game printer 30 is used for "cashing out" machine credits when a player wants to end game play or to move to another machine. A player cashes out by selecting appropriate buttons on the gaming device 10, and then by indicating if he or she wants to be paid out in cash or in voucher. If the player desires to be cashed out in cash, bills can be ejected through the bill acceptor 20 or bill slot 26 of the internal hopper 24, or coins or tokens can drop from the hopper 24 into the payout bin 28. If the player wishes to be cashed out with a voucher or ticket, such a voucher can be printed by the game printer 30. The voucher can then be taken to a casino attendant to be converted to cash, or could be inserted into the bill acceptor 20 of another gaming device 10, which validates the voucher and transfers the value to the credit meter of the new game.

In addition to printing tickets related to game and bonus functions, such as a cashout voucher, the game printer 30 can print tickets for bonus awards and system awards as well. Detailed discussion of the tickets and awards follows.

The gaming device 10 also includes game-mounted components of a player tracking system. The components are generally shown affixed to a frame 40, which is mounted to the gaming device 10. Although components of the tracking system interact with the gaming device 10, it is a separate system from the gaming device.

The player tracking system includes a set of electronic inputs and outputs for interfacing with the player. For example, in the gaming device shown in FIG. 1, portions of the player tracking system mounted to the frame 40 include a cardslot with a card reader 42, a keypad 44, and a text display screen 46. The display screen 46 may be a fluorescent type or LED type text display, for instance. A player of the gaming device 10 uses a card and/or a PIN code to identify himself or herself to the player tracking system. Monetary value can be entered into the game, either from the ID card itself, from a credit-card account with a bank or from a special gaming account managed by a casino. Alternatively, a player can use the card and/or PIN code to identify himself or herself, and then put credits on the machine by depositing coins, tokens, bills, or tickets/vouchers into the machine.

The card reader 42, keypad 44 and screen 46 are managed by functions operating on a "bonus engine" 50, which is a specialized piece of hardware used in the player tracking network. The bonus engine 50 is coupled by a computer connection to the gaming network, and plays a central role in the player tracking system. The bonus engine 50 is in constant communication between the game electronics 15 and the gaming network. The bonus engine 50 receives constant status updates about the state and status of the game device 10. The game electronics 15 may automatically send information to the bonus engine 50, such as "events", when the events occur, such as at the end of the game, or when a key event happens like a coin being accepted into the gaming device 10. Or, the bonus engine 50 may send electronic updates, requests, or polls to the game electronics 15. When polled, the game electronics 15 sends the latest events to the bonus engine 50. Additionally, the gaming network can send commands and directives to a particular gaming device 10 through the bonus engine 50 of that device. The bonus engine 50 then performs the commands, such as by displaying a message on the display 46, or the bonus engine delivers the commands to the game electronics 15 of that gaming device.

Bonusing and bonus awards are well known in the gaming industry. For example, some bonus awards are described in U.S. Pat. Nos. 5,655,961; 5,836,817; 5,752,882; 5,820,459; 6,257,981; 6,319,125; 6,254,483; 6,364,768; 6,358,149; 5,876,284; 6,231,445; 6,375,569; 6,244,958; 6,431,983; 6,371,852; 6,375,567, all of which are assigned to the assignee of the present invention, and the teachings of all of which are incorporated herein by reference for all purposes.

One of the commands that can be either generated by the bonus engine 50 or sent to the bonus engine by the gaming network is a command indicating a bonus award or a system award should be generated. Hereinafter, the word "award" will indicate either a system award or a bonus award, and the two types will not be differentiated unless a particular type of award is being discussed. As discussed below, the bonus engine 50 is structured to either print the award ticket directly on the game printer 30 or on a separate system printer. In other embodiments, the bonus engine 50 is structured to send appropriate commands to the game electronics 15 to cause the award to be printed on the game printer 30.

Figure 2:
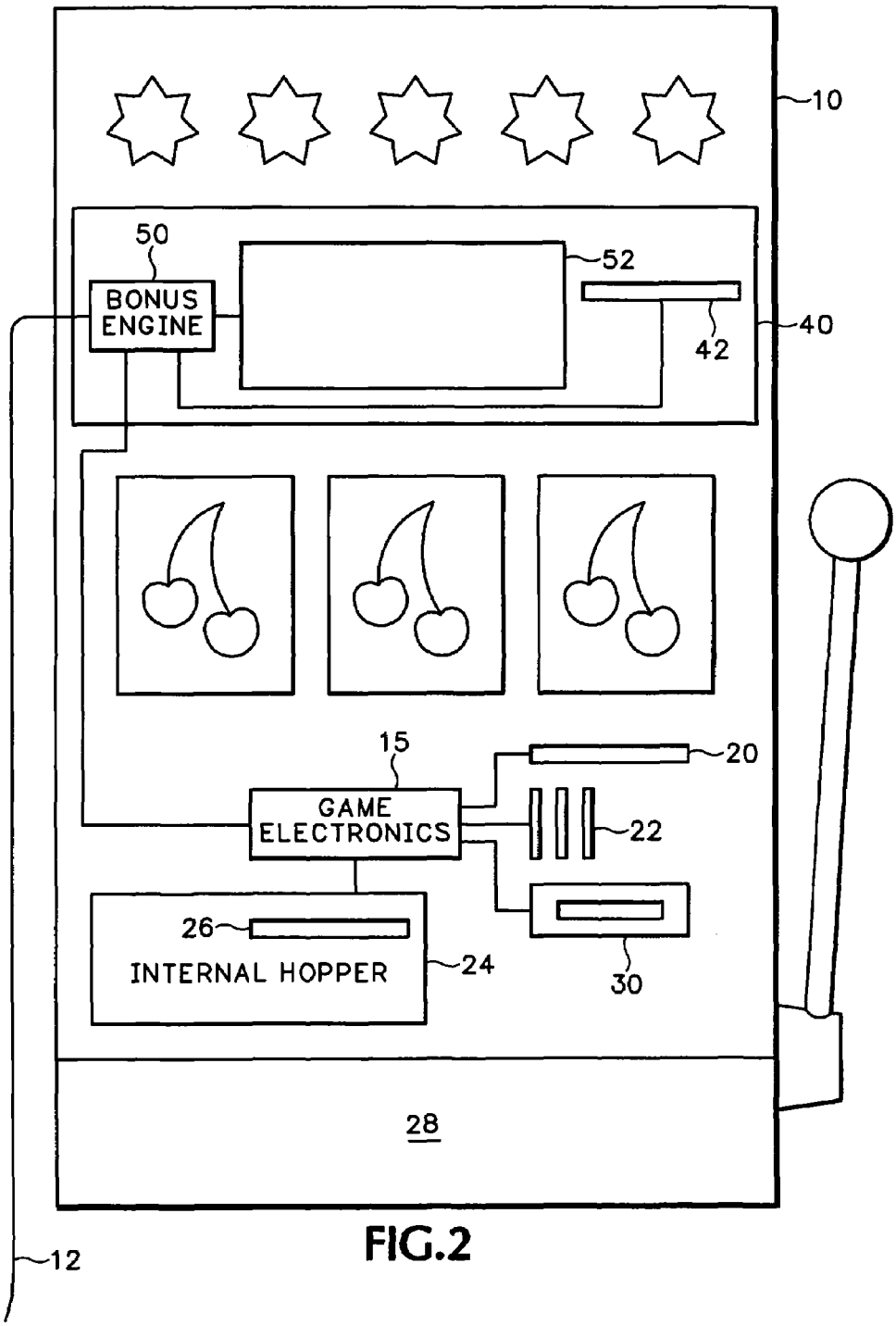
FIG. 2 is a diagram showing a gaming device including a ticket printer, but having a different player communication system than the gaming device of FIG. 1.

FIG. 2 shows a gaming machine 10 having a different player tracking configuration than the gaming machine of FIG. 1. Specifically, the input and display functions of the keypad 44 and display 46 of FIG. 1 are performed by a touchscreen display 52, such as a Liquid Crystal Display (LCD). A detailed description of such a touchscreen display 52 is described in U.S. patent application Ser. No. 10/170,238, filed on Jun. 11, 2002, and is incorporated herein by reference for all purposes. As described in the Ser. No. 10/170,238 application, the bonus engine 50 manages the touchscreen display 52, and card reader 40, as well as provides the bonusing and other functions described above.

Figure 3:
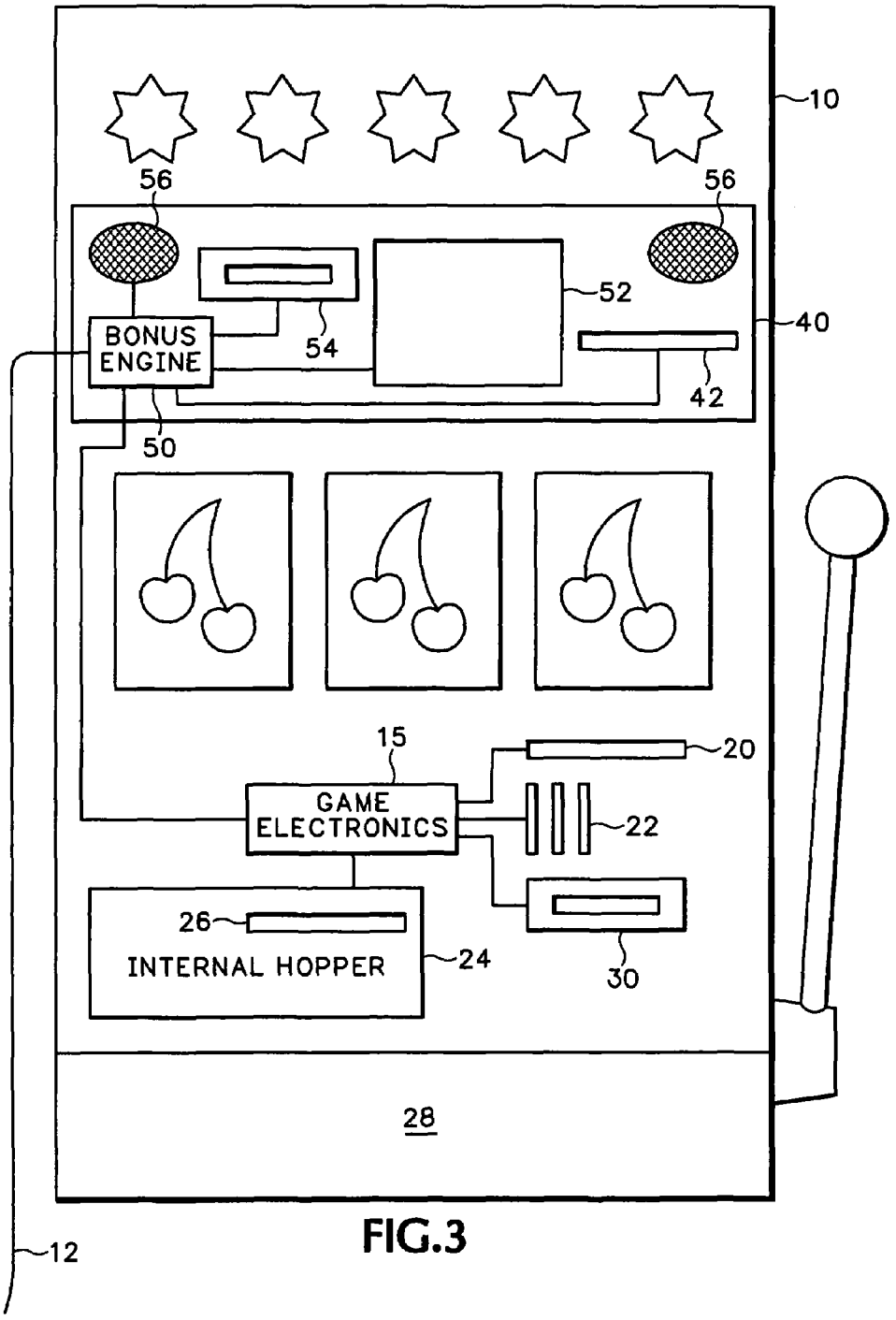
FIG. 3 is a diagram showing a gaming device including a game ticket printer and a system ticket printer, according to a further embodiment of the invention.

FIG. 3 shows yet another variation of the gaming device 10. This variation includes a system printer 54 and speakers 56 mounted to the frame 40 of the player tracking system. The system printer 54 and speakers 56 are also coupled to and managed by the bonus engine 50. The system printer 54 works in conjunction with the game printer 30 in that the system printer 54 prints the awards while the game printer 30 prints the traditional game cashout vouchers. The speakers 56 can be made to produce sounds or music by the bonus engine 50. Although only shown in FIG. 3, the speakers 56 could be present on any of the gaming devices depicted in FIG. 1, 2, or 3, although they need not be present on all embodiments of the invention.

Although the gaming devices 10 of the FIG. 1, 2 or 3 are all different, they are each capable of performing embodiments of the invention. Although the specific hardware included in the gaming device 10 is important in implementing embodiments of the invention, the invention can operate regardless of the type of components in the gaming device 10.

Figure 4:
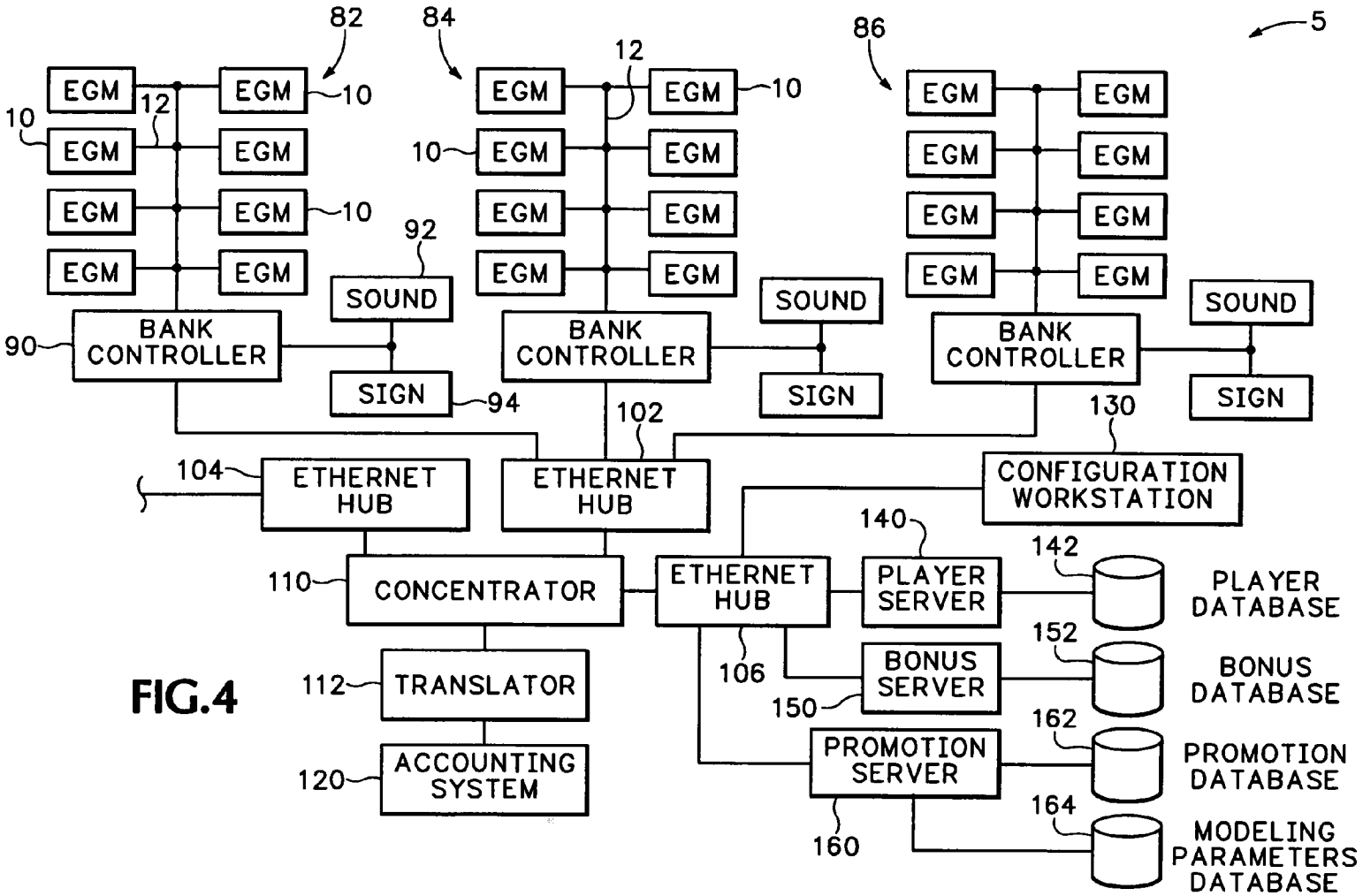
FIG. 4 is a block diagram showing a network of gaming devices including a promotion function according to embodiments of the invention.

As mentioned above, the gaming device 10 shown in FIGS. 1, 2, and 3 operates in conjunction with a gaming network. An example modem gaming network 5 is shown in FIG. 4. FIG. 4 is similar to FIG. 1 of U.S. Pat. No. 6,245,483B1, assigned to the assignee of the present invention, the teachings of which are incorporated herein in their entirety for all purposes. In FIG. 4, several gaming devices 10 (Electronic Gaming Machines, or EGMs) are coupled together in groups called banks. The three banks illustrated in FIG. 4 are referenced as 82, 84, and 86, although any number of banks could be present in the gaming network 5.

Each of the gaming devices 10 in each bank are coupled to a bank controller 90 by the communication cable 12. Each bank controller 90 includes a processor that facilitates data communication between the gaming devices 10 in its associated bank and the other components on the network. The bank controller 90 can also include audio capabilities, like a CD or DVD ROM drive coupled to an audio board or sound card for transmitting digitized sound effects, such as music and the like, to a sound system 92 coupled to the bank controller. The bank controller 90 can also be connected to an electronic sign or screen 94 that displays information, such as scrolling, flashing, or other types of messages that indicate jackpot amounts and the like, which are visible to players of machines on a particular bank. These message displays 94 are generated and changed responsive to commands issued over the network 5 to the bank controller 90. Each of the other banks 84 and 86 include associated bank controllers, sound systems, and signs as shown, which operate in substantially the same manner. The sounds and images created by the bank controller may be identical for each of the banks 82, 84, 86, or all of sounds and images created by the banks may be different than the others.

A network connector, such as an Ethernet hub 102 connects each of the bank controllers 90 to a concentrator 110. Another Ethernet hub 104 connects similar bank controllers (not shown), each associated with an additional bank of gaming devices 10 (also not shown), to the concentrator 110. The concentrator 110 functions as a data control switch to route data from each of the banks to a translator 112. The translator 112 includes a compatibility buffer between the concentrator 110 and a proprietary accounting system 120. The translator 112 functions to place all the data gathered from each of the bank controllers 90 into a format compatible with the accounting system 120. The translator 112 could be implemented by a microcomputer including a microprocessor and operating system, such as an Intel Pentium microprocessor running Microsoft Windows NT 4.0.

Another Ethernet hub 106 is connected to a configuration workstation 130, a player server 140, a bonus server 150 and a promotion server 160. Hub 106 facilitates data flow to or from the configuration workstation 130 and the servers 140, 150, and 160. Additionally, the servers 140, 150, and 160 communicate through the concentrator 110 to the bank controllers 90, which, in turn, communicate with the particular gaming devices 10.

The configuration workstation 130 has a user interface that allows portions of the network 5 and the servers 140, 150, and 160 to be set up and modified. The configuration workstation 130 could include a personal computer having a keyboard, monitor, microprocessor, memory, an operating system, and a network card coupled to the Ethernet hub 102.

The player server 140 includes a microcomputer that is used to track data of players using the gaming devices 10. The player server 140 is coupled to a player database 142 where the player tracking data is stored. Another function of the player server 140 is to control messages that appear on displays 46 or 52 associated with each gaming device 10 and the messages on the signs 94 coupled to the bank server 90. The player server 140 may be embodied in a microcomputer including, for instance an Intel Pentium Processor, Microsoft operating system and a network card to couple the server to the Ethernet hub 106.

The bonus server 150 is embodied by a microcomputer and is used to control bonus applications or bonus systems on the gaming network 5. The bonus server 150 is coupled to a database 152 where bonus data is stored. The bonus server 150 implements includes a set of rules for awarding jackpots in excess of those established by the winning pay tables of each gaming device 10. Some bonus awards may be made randomly, while others may be made to link to groups of gaming devices 10 operating in a progressive jackpot mode. Specific examples of such bonuses and networks used to implement them include those as described in US patents mentioned above and previously incorporated.

The promotion server 160 is coupled to a promotion database 162 and a modeling parameters database 164. The promotion server 160 includes functions and processes operative to generate signals to cause a system award to be generated, and to communicate the generated system award to the particular gaming device 10 at which the player receiving the award can receive the award.

Data of different types of system and/or bonus awards and how and when the awards are generated can be stored in the promotion database 162. For instance, the text and/or graphics that is printed on an award, or bar-codes that are printed on the award ticket can be stored on the promotion database 162. Modeling parameters and data can be stored on the modeling parameters database 164. For instance, triggering conditions that when satisfied cause a ticket to be generated can be stored on this database. Such data could include the number of hours a player must play at a requisite coin-in level to cause a complementary meal ticket to be awarded to the player. Many examples of system awards and parameters used to implement them are discussed in detail below.

In determining when to grant a bonus or system award, the promotion server 160 can access data stored anywhere on the network looking for triggering events, such as: from any of the databases 142, 152, 162 and 164; from the configuration workstation 130; from the bank controller 90; from the accounting system 120; and from the bonus engine 50 on any or all of the gaming devices 10 coupled to the computer network 5. Additionally, the computer network 5 illustrated in FIG. 4 is only an example gaming network. Those skilled in the art will appreciate that embodiments of the invention can operate on any acceptable network, even if it differs from the one illustrated in FIG. 4.

When the promotion server 160 determines that a triggering event has been satisfied and that an award should be generated, it sends appropriate signals to the bonus engine 50 of the appropriate gaming device 10 through the gaming network 5 to deliver the award. As discussed above, one such method of award delivery is to cause an award ticket to be printed for the player.

Figure 5:
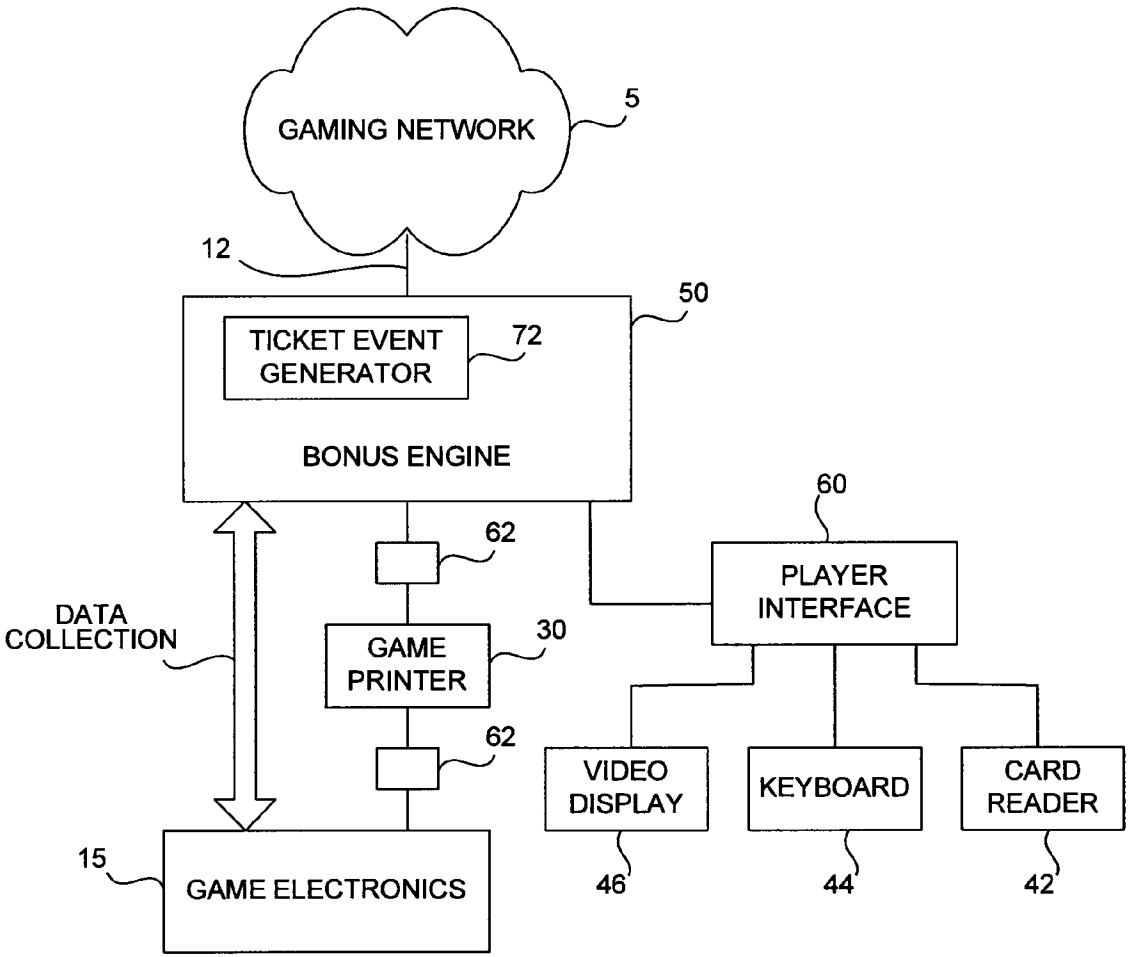
FIG. 5 is a functional block diagram showing processes and functions used in the gaming device of FIGS. 1 and 2.
Figure 6:
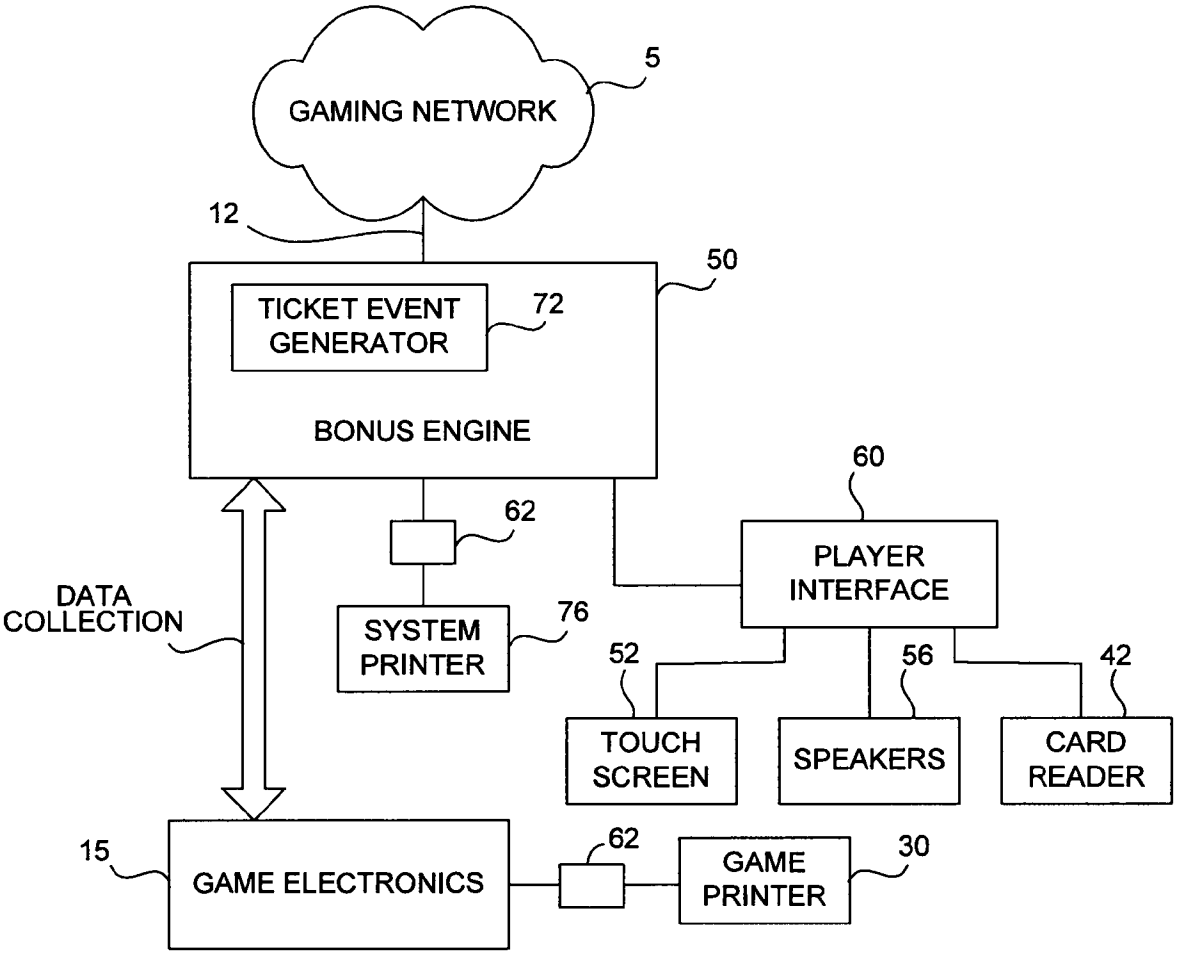
FIG. 6 is a functional block diagram showing processes and functions used in the gaming device of FIG. 3.

Details of how the bonus engine 50 causes the award tickets to be printed are shown in FIGS. 5 and 6. These figures are sample block diagrams showing example control functions and data connections between components of the gaming device 10 of FIG. 1. Functions operating on the illustrated components may be implemented in any way, such as by standalone hardware circuits, software processes running on a dedicated or shared processor, firmware, etc. or a combination of those implementations. Similarly, the functions could be procedures running on a general purpose or specialty microprocessor. Further, although components are shown as distinct interconnected components, the functions that are represented may operate in conjunction with one another in an overlapping manner.

As shown in FIG. 5, the bonus engine 50 is coupled directly to a data cable 12, which, in turn is coupled to the gaming network 5. The data cable 12 allows the bonus engine 50 to communicate game and player events to the game network 5. Additionally, the game network 5 sends commands and data to be performed or managed by the bonus engine 50.

The bonus engine 50 is coupled to the game electronics 15 through a data collection link, shown as a double arrow. The bonus engine 50 and the game electronics 15 may communicate using a data collection protocol, such as a Slot Accounting System protocol, or by any other acceptable protocol.

The bonus engine 50 is additionally coupled to the set of player communication tools—the card reader 42, keyboard 44 and text display 46. In some embodiments, the bonus engine 50 may be coupled to these player communication tools through a separate player interface 60, which routes commands and data from the bonus engine 50 to the appropriate tool. In other embodiments, the bonus engine 50 controls these operations itself, and no separate player interface 60 is necessary.

Within the bonus engine 50 is a ticket event generator 72. The ticket event generator is operative to cause the system award ticket or bonus award ticket to be printed. As discussed above, the granting of an award may occur on the promotion server 160, the bonus server 150, or may occur on the bonus engine 50, or some portions of the grant may occur on either the promotion or bonus server and on the bonus engine. For instance the bonus engine 50 may monitor events from the game electronics 15 and grant a special award when an award-causing (triggering) event occurs—without first sending data to the promotion server 160. Of course, once the award was generated, the bonus engine 50 would send the appropriate data to the gaming network 5, and specifically to the player server 140, bonus server 150, promotion server 160, and the accounting system 120.

The bonus engine 50 may be coupled directly to the game printer 30, or may be connected to a game printer interface 62 that in turn is coupled to the game printer 30. In either such an embodiment, the bonus engine 50 can generate requests to print award tickets and have them printed directly on the game printer 30, without sending intermediate commands to the game electronics 15. The bonus engine 50 or printer interface 62 may communicate directly to a port on the printer using a serial or parallel printing protocol, for instance. Alternatively, the print requests may be generated by the promotion server 160 or elsewhere on the gaming network 5, and communicated to the bonus engine 50 over the data cable 12. The bonus engine 50 in turn can then send appropriate commands to the printer interface 62 to control the game printer 30 to print the desired ticket.

In another embodiment, also shown in FIG. 5, the bonus engine 50 sends the print commands to the set of game electronics 15 over the data connection link, rather than controlling the game printer 30 directly. Once the game electronics 15 receives the print command from the bonus engine 50, it performs any necessary translation and sends the appropriate signals to the game printer 30 to print the award ticket. As above, the game electronics may be connected to the game printer through a game printer interface 62, which may or may not be identical to the game printer interface coupled to the bonus engine 50.

Therefore, in operation as illustrated in FIG. 5, the bonus engine 50 either generates or receives a command from the gaming network 5 to print an award. Once the command is generated or received, the bonus engine 50 either prints the award ticket directly on the game printer 30, or sends appropriate commands to the set of game electronics 15 to have the award ticket printed.

FIG. 6 illustrates an embodiment of the invention that includes two printers attached to the gaming device 10—a standard game printer 30 and a system printer 54. As discussed above with reference to FIG. 3, the system printer 54 can be identical to or different from the standard game printer 30.

As shown in FIG. 6, the bonus engine 50 is coupled directly to a system printer interface 64, which in turn is coupled to the system printer 54. In some embodiments, the functions of the printer interface 64 are built directly into the bonus engine 50 so that a separate printer interface is unnecessary. As in the other embodiments, the game electronics 15 are still connected to the standard game printer 30, and are used to print standard game items, such as cashout vouchers. In this embodiment, the system printer 54 is controlled by the bonus engine 50 solely to print system and bonus awards.

Also different from the gaming device shown in FIG. 5 is that the gaming device 10 of FIG. 6 is coupled to the touch-screen 52 and speakers 56 that were described with reference to FIG. 3. As described above, embodiments of the invention are capable of operating equally no matter the type of system used to communicate with the player of the gaming device 10.

Figure 7:
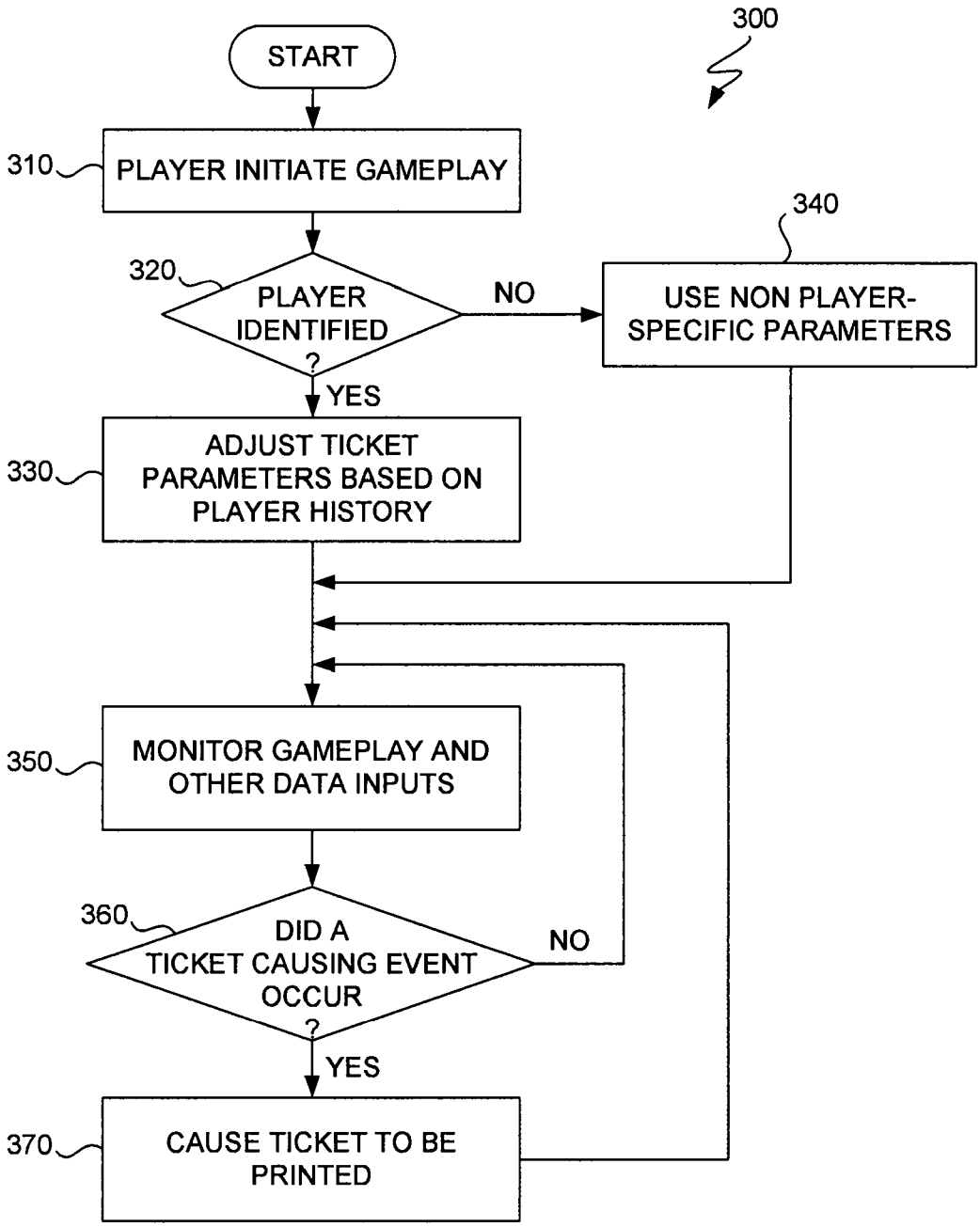
FIG. 7 is an example flow diagram showing processes that can be performed by the ticket printer function of FIGS. 4-6.

FIG. 7 is an example flow diagram illustrating processes that can be used by the promotion server 160 or ticket event generator 72 to cause an award to be generated and an award ticket printed at a gaming device 10. For brevity, functions relating to generating an award will be referred to as occurring on the promotion server 160, although they could be performed on either the promotion server, bonus server 150, bonus engine 50, or elsewhere in the computer network 5. Similarly, printing awards will be referred to as being printed on a system printer 76, although they could also be printed on a game printer 30, either under direct control of the bonus engine 50, or under control of the game electronics 15 after receiving commands and data from the bonus engine.

A flow 300 begins at a process 310 where a player initiates gameplay on a gaming device 10 that is coupled to the gaming network 5. A player may initiate gameplay by entering coins or bills into the gaming device 10, or by using a card and/or PIN number to transfer money from a casino account, for example.

A check is made at 320 to see if the player has been identified to the gaming network 5, either as a new player or as a returning player. If the player is so identified, a process 330 loads data from the player database 142, and/or adjusts parameters in the promotion server 160. Otherwise, a process 340 loads non-player specific parameters to the promotion server 160. In some embodiments, the process 340 is presumed, and the non-player specific parameters are pre-loaded into the promotion server 160 when the function begins, and are only overwritten if there is in fact data about the current player stored in the player database 142. Information from the promotional server 160 may be also used by the bonus server 150.

A process 350 monitors gameplay as well as other data inputs. Some of the other data inputs can include time of day, and the presence of special promotions, for example. In implementation, the other data inputs can include a large variety of inputs, which are described in detail below.

If a check 360 does not find a ticket causing event to have occurred, then the flow 300 simply loops back to the process 350, and the monitoring continues. If, instead the check 360 finds that a ticket causing event occurred, then the promotion server 160 or bonus server 150 loads the appropriate data and sends a signal to the bonus engine 50 of the appropriate gaming device 10 to cause the printer 76 to print an award ticket. For instance, if a player has played for over 3 hours at a requisite level, the promotion server 160 may cause a ticket for a free meal (a complementary or "comp" meal) to be printed at the game device 10 where the player is currently playing.

In other embodiments, the ticket printer can also be used as a vehicle to issue a receipt. For instance, a ticket could be printed at a gaming machine that confirms a transfer of funds or credits to a player. For example, if a player electronically transferred funds into a player account, the ticket printer could be used to print a receipt that confirms how much the player transferred, and/or how much is remaining in the player's account.

Triggering Events

Generally, using the award system described above, an award is generated after an award triggering event occurs. As described above, a trigger event occurs when conditions caused by the customer, the game itself or gaming network satisfy one or more pre-set conditions. The pre-set conditions are "triggers", and when a trigger's conditions are satisfied, the trigger event occurs.

The triggers are typically static, such as awarding a complementary meal coupon when a player has a requisite amount of coin-in over a meal period. Other triggers can be dynamic or based on dynamic variables, such as awarding a free return play to the top 10% of players in a casino or group of casinos over a given time period.

A list of example groups of triggering events is listed below in Table 1.

TABLE 1

List of Trigger groups, by type:

| Machine Outcome | Player Behavior | Random Triggers |
|---|---|---|
| Specific Game Outcomes | Points Earned | Lucky Coin |
| Series of Game Outcomes | Win/Loss Per Unit of Time | Lucky Time |
| Sets of Game Outcomes | Visitation Frequency | Lucky Game |
| Consecutive Game Outcomes | Handle Per Unit of Time | Electronic Drawing |
| X outcomes in N tries | Continuous Play | |
| Outcome sets/unit time | Specific Player Demographics | |
| Outcomes relative to others | Sets of Player Demographics | |

Trigger Definitions:

A "Specific Game Outcomes" triggering event occurs when the player obtains a predefined result on a game on the gaming device. Examples include, for instance, a "four-of-a kind" (or a particular four, such as four aces) in a poker game, "seven-seven-seven" in a slot game, or obtaining a particular bonus symbol on one of the reels. An award can be generated when any particular predefined outcome of the game is met.

A "Series of Game Outcomes" triggering event occurs when the player obtains certain results during multiple plays on the gaming machine device in a predetermined order. One example is where a player obtains, on a video poker machine, a pair, two pairs, three-of-a kind, straight, and flush in that order but not necessarily consecutively. An award can be generated when any predefined series of results is met.

A "Sets of Game Outcomes" triggering event occurs when the player obtains certain results during multiple plays on the gaming machine regardless of order. Examples include a player receiving his/her fourth four-of-a-kind on a video poker machine, or a player obtaining jackpot payouts on each of the possible paylines in a slot-based game. An award can be generated when the last in the predefined set of results is met.

A "Consecutive Game Outcomes" triggering event occurs when the player obtains certain consecutive results during multiple plays on the gaming machine. Examples include a player winning on five consecutive hands or receiving two consecutive hands containing a minimum level of win (such as three-of-a-kind) on a video poker machine, or where a player receives a particular bonus symbol on the payline of a slot machine three consecutive times. An award can be generated when the last of the predefined consecutive game outcomes is met.

An "X Outcomes in N Tries" triggering event occurs when the player obtains certain results during multiple plays on the gaming machine within a certain number of tries. Examples include a player obtaining a both a straight and a flush within five games of one another, but not necessarily consecutively or in that order, or where a player obtains seven-seven-seven during the first 50 plays of a particular slot machine. An award can be generated when the "xth" outcome is reached by the player.

An "Outcome Sets/Unit Time" triggering event occurs when a player obtains certain results during multiple plays on the gaming machine primary game within a set period of time. Examples include a player obtaining 10 jackpot awards on a slot machine within a ten minute period, and a player obtaining three flushes within a one-hour period on a video poker machine. This type of trigger allows the operator to specify the game outcomes and the time limit required for the trigger.

An "Outcomes Relative to Others" triggering event occurs when a player obtains a certain result or results on the gaming device before (or after) other players at a specified group of games. Examples include the first player in a bank of video poker machines to receive a four-of-a-kind of Aces, or the first one to twenty wins.

A "Points Earned" triggering event occurs when a player earns a certain number of points on the gaming device, such as: bonus points, Xtra credit points, or even machine credits. An award can be generated when such a minimum point level is met.

A "Win/Loss Per Unit of Time" triggering event occurs when a player obtains a certain number of wins or loses on a gaming device over a predetermined time period. Examples include a player losing 100 times over a 20 minute time period, or where a player wins 7 times over a one-minute period.

A "Visitation Frequency" triggering event occurs to reward players for frequent visits to the casino(s). Examples include triggering the award upon the third consecutive day the player visits a particular casino, the fifth visit to any casino within a group of casinos within a year, or after a player has played for a total of twenty-four hours of non-continuous play. Flags maintained within the player database 142 within the gaming network 5 allow a casino to track this type of visitation and play criteria over a long period of time.

A "Handle Per Unit of Time" triggering event occurs for players betting a certain amount over a certain time period. Examples include a player betting at least a total of $500 at a slot machine over a one-hour period, or where a player bets his/her 1000.sup.th coin at a nickel poker machine.

A "Continuous Play" triggering event occurs after the player has continuously played on a machine for a preset time period. For instance, the award might be triggered every ten minutes of play, or a super promotion after two hours of continuous play.

A "Specific Player Demographics" triggering event occurs only for those players fitting the specific profile designated. For instance, the casino might run a promotion where players from Chicago or from out of state receive the promotion the first time during any one day that they play particular machines. The demographic information is stored in the player database 142 on the gaming network 5, and the player ID is established when the player inserts his/her player tracking card and/or typing in a PIN. Additionally, player demographics stored in the promotion server 160 or elsewhere on the gaming network 5 can include player grouping or ranking used to signify the betting patterns of different players. For instance, "high rollers" would have higher rankings than lower betting players.

A "Sets of player Demographics" triggering event occurs for those players fitting more than one (and perhaps all of the) designated profiles that are stored in the promotion server 160 or elsewhere on the gaming network 5. For instance, the casino might run a promotion for seniors aged 65 and older who come from out of state. Again, the individual demographic information is stored in the player database 142 coupled to the player server 140 on the gaming network 5.

A "Lucky Coin" triggering event occurs for a player inserting the xth coin-in on a certain pre-designated portion of the games coupled to the gaming network 5. An award can be generated when the coin is inserted or credit otherwise transferred.

A "Lucky Time" triggering event occurs for a random player playing at a designated time of day.

A "Lucky Game" triggering event occurs for a random player who is playing on one of the gaming devices coupled to the gaming network 5.

An "Electronic Drawing" triggering event occurs where a player is awarded a drawing ticket. Detailed discussion of this trigger event appears below.

These are only a small sample of potential triggering events that can be contemplated and the invention should not be so limited to those disclosed and described. Embodiments of the invention could conceivably use any data accessible anywhere in the gaming network 5 to create a trigger. The triggers could be as simple as to award system awards to everyone who is playing at 3:00 pm Friday to as complex as imaginable. A trigger may have a single component, such as that described above, or could have dozens of components (e.g.: a free spin to players who have a current coin-in level that is 15% higher than their coin-in average for the last month if the player is playing at a game introduced in the last 4 months and is staying in the casino hotel). The number of different triggers possible in the gaming network 5 is nearly infinite. Implementation overhead, however, may limit the casino to minimizing the number of components of a trigger, or the amount of calculation that has to be performed to check whether certain trigger conditions have been met.

Triggering events need not be applied uniformly to all of the gaming devices coupled to the gaming network 5, or to all of the players playing the gaming devices. There may be different triggering events or sets of triggering events for different groups of gaming devices. For example, with reference to FIG. 4, a first set of triggering events could apply to the EGMs 10 that are in bank 82, but not to those EGMs in banks 84 and 86. That is, there could be a triggering event implemented, such as generating a drawing ticket after "x" minutes of play, where "x" is 40 minutes for EGMs in bank 82, 50 minutes for EGMs in bank 84 and 60 minutes for EGMs in bank 86. Of course, although illustrated here as groups of EGMs associated with a particular bank, any of the EGMs 10 within the entire network 5 could have one or more triggering events that are different from any other EGM.

The same level of control extends to player groupings as well. For instance, certain triggering events could be set up for those players who have signed up for player tracking in the past 6 months, while another set of triggers applies to other players. Individual tailoring of a gaming network based on player identity is disclosed in copending application entitled "Player Specific Game System", filed Sep. 18, 2002 and having Ser. No. 10/247,786, which is assigned to the assignee of the present invention and incorporated herein by reference for all purposes. One way to tailor the gaming network is to have different triggers for groups of players, or for individual players themselves.

Using the Ticket Printer System in Game Promotion

Once a ticket printing system such as the one described above is established, several types of promotions to promote game play can operate on such a system. The promotions can include generating system award tickets for the player, as described below.

One such promotion is a drawing ticket promotion. In this promotion, a player identifies himself or herself to the player server 140 on the gaming network 5. Once identified, bonus points are accumulated based on amount of play, such as "coin-through", as is known in the art, and tracked in the player account stored on the player database 142. Once the bonus points have accumulated to 100, or some other set number, the promotion server 160 causes a "drawing ticket" to be printed for the player. The drawing ticket is a system award. In some embodiments, the promotion server 160 will generate a "drawing" ticket for each 100 bonus points that the player accumulates. Each drawing ticket has a unique number printed on the ticket, and data of the drawing ticket is stored in the player database 142. At a pre-determined time, a drawing is held for a prize, such as money, credits, or another type of prize. One of the numbers that was printed on the drawing tickets that were generated during a given time period is selected as the winning ticket. The drawing rules may require that the player be present to win. Doing so could encourage players to return at a specific time, which could in turn promote additional play on the gaming machines. Or, because the numbers on the drawing tickets can be automatically associated with a player and stored in the player's account, the player would not necessarily need to be present to win.

In operation, this promotion could use data from each of the databases illustrated in FIG. 4. For instance, player data such as past playing history from the player database 142 can be considered. Bonus data from the bonus database 152 may also be used. Data regarding when and where to generate the system award, and formatting data used to print the ticket can be retrieved from the databases' 162, 164. Additionally, modeling parameter data, such as the requisite number of bonus points accumulated prior to generating the drawing ticket, can be retrieved from the parameter database 164. The promotion server 160 can utilize data from each of those inputs and others on the gaming network 5 to determine when to generate the ticket.

Also, referring to FIG. 7, the ticket printing promotion can implement the looping processes 350 and 360 while it is continuously monitoring the important parameters. Once all of the parameters are present to cause a ticket to be generated, the flow 300 passes to the process 370, where the ticket is generated. Once the ticket is generated, the flow 300 returns to the process 350 to again monitor the data inputs.

Another type of promotion could be used to encourage an unidentified player to become an identified player. Sometimes, for privacy or other reasons, players do not want to be identified. Or, perhaps a player didn't have a player identification card with them when they went to play at a particular casino.

The promotion involves identifying a player who is accumulating bonus points but, because the player is unidentified, the bonus points are not credited to a certain player account. The unidentified player is invited to identify himself or herself and have the bonus points added to either a new or their existing player account. Possibly the player may be convinced to identify himself or herself, which can benefit the casino, if the potential player award is high enough. In this promotion, the promotion server 160 monitors the gameplay of a non-identified player. If the player exceeds a threshold that indicates they are doing well, for example if they accumulate over 25 bonus points, the promotion server 160 causes a prize ticket for a system award to be awarded. The player can take their prize ticket to a customer service desk in the casino to claim their prize. However, the player must sign up for a player account to be eligible to receive the prize. If the player was in fact a player who already had an account but did not identify themselves to the gaming network, then the bonus points that the player accumulated could be credited to the proper account at the customer service desk.

In this instance the ticket could print with a particular numerical code that identified how many bonus points that were accumulated. Then, the casino employee can access the gaming network to properly credit the accumulated bonus points, based on the numerical code assigned.

Another promotion encourages the player to stay in a hotel associated with the particular casino in which the player is playing. One of the items that can be stored in the player database 142 is whether the player is staying in the hotel associated with the casino where the gaming network 5 is installed. A promotion to encourage the player to stay in the casino hotel operates by using this information in conjunction with other parameters stored in the modeling parameters database 164 or player database 142. For instance, the promotion server 160 can monitor the gameplay of the player who is not staying in the hotel. Once the player has played for a certain period of time, for example over 3 hours, the promotion server 160 can grant a system award offering a complementary or discounted room in the casino. If the player is staying at the particular casino's hotel, they may be more likely to play the games for a longer period of time.

Another promotion utilizes the ticket printer 76 in conjunction with the keyboard 42 and display 46 or touchscreen 52 mounted on the gaming device 10. In such a promotion system, the promotion server 160 determines that some sort of system award should be given to the player, but allows the player to choose which system award they would like. In implementation, when an event causes the promotion server 160 to send a system award to the player, instead of instructing the bonus engine 50 to cause a ticket to be printed, a selection mechanism is provided to the player. For instance, the bonus engine 50 may cause a display to be shown on the touchscreen 52 that includes several different prizes. For example, a player could be given the choice of a complimentary meal or bonus credits. Or the player could be given the choice of a meal, bonus credits, and one or more drawing tickets (described above). The player could then make his or her selection from the items displayed, and the bonus engine 50 would cause the appropriate system award ticket or receipt to print at the printer 76. For instance, if the complementary meal were selected, a meal voucher would be printed for the player that can be redeemed in the casino restaurant.

Another promotion using the ticket printer 76 can encourage a player to return. For instance, when the player cashes out or decides to leave, a ticket inviting the player back is printed at the printer 76. The ticket could indicate that if the customer returns within a certain time, for instance 24 hours, the player will qualify for a system award of free play or bonus credits. Of course, the time period in which to return and the amount of system award given upon return can be adjusted by the casino operator.

Another promotion utilizes both the display screen 46 or 52 and the ticket printer 76, but need not actually be related to the gaming device 10. For instance, a player may identify himself or herself to the gaming network 5 by inserting a casino card and/or entering a PIN number. Then, the bonus engine 50 or other portion of the gaming network 5 generates a menu where the player can view the status of the player's account. For instance, the player could check to see how many bonus points they have accumulated. Then, by making appropriate selections on the display screen 46 or 52, the player can manage their bonus account. For example, the player could choose to convert some of their bonus points into a complementary meal. In such a case, bonus points are deducted from the player's account, and a complimentary meal ticket for the system award is printed at the ticket printer 76.

A further method of using the ticket printer 76 is to print instructions or a receipt for use by the player. For example, if the player is potentially confused about the rules of a particular game, or would like clarification on the way a bonus works, a selection can be presented on the display 46, 52. When the player makes a selection, the bonus engine 50 causes the ticket printer 76 to print out the rules or instructions on a ticket or series of tickets for the player to have and take with him or her.

By generating tickets for awards at appropriate times, a casino can promote loyalty from its patrons. For instance, by specially rewarding customers who play many hours at the games, customers are likely to play longer than if they weren't rewarded.

Although examples of machines and processes have been described herein, nothing prevents embodiments of this invention from working with other types of machines and processes. Implementation of the promotion system is straightforward in light of the above description. As always, implementation details are left to the system designer. The specific circuits and procedures used to decide when tickets should be produced, and the way the actual tickets are produced may be implemented in any way, with any components, so long as they can generate the desired effect. Inclusion of description or illustration of a function in either the gaming device or the gaming network is not dispositive that the function is located in or must be performed there. The award generating system works even when not all of the illustrated functions are present Examples of Printed Tickets FIGS. 8-13 show examples of tickets representing awards that can be printed at the gaming device 10 using embodiments of the invention. As described above, when the award is granted by the gaming network, codes are generated by the ticket event generator 72 on the bonus engine 50 (or elsewhere on the gaming network 5) to cause the game printer 30 (FIG. 5) or the system printer 76 (FIG. 6) to generate the tickets. A record of the generated ticket is stored in the player database 142 and/or elsewhere on the gaming network 5. For instance, the record of the generated ticket may also be stored in the bonus database 152, promotion database 162, and/or on the modeling parameters database 164 (FIG. 4).

Figure 8:
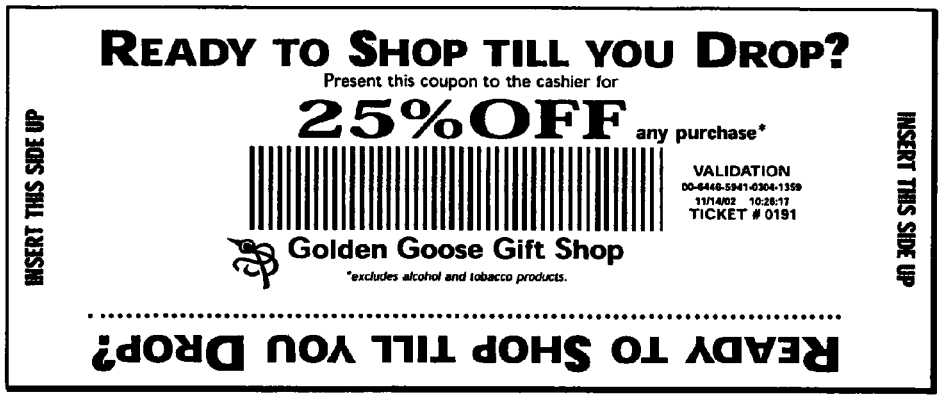
FIGS. 8-13 are examples of tickets that can be issued by embodiments of the invention.
Figure 9:
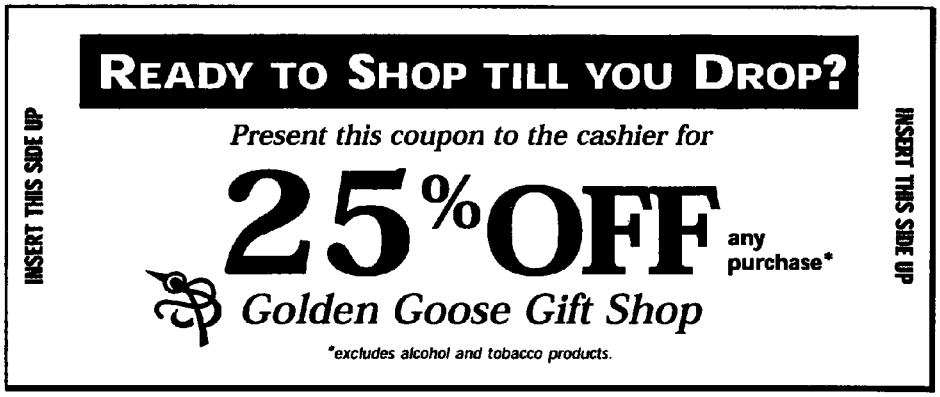
Figure 10:
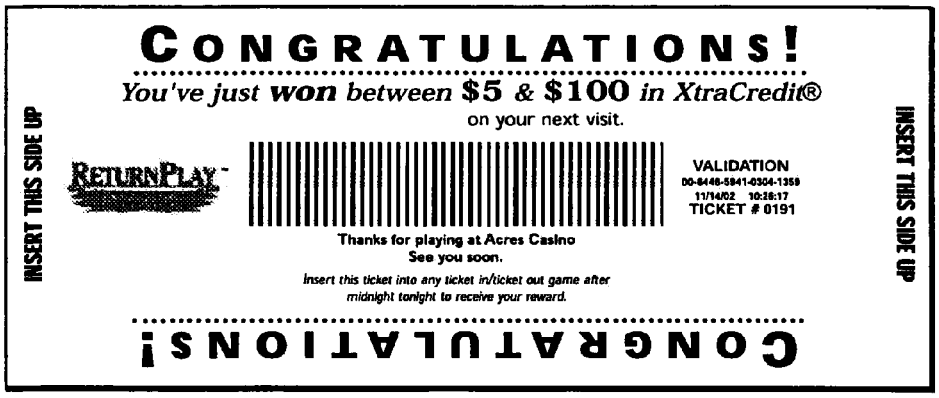
Figure 11:
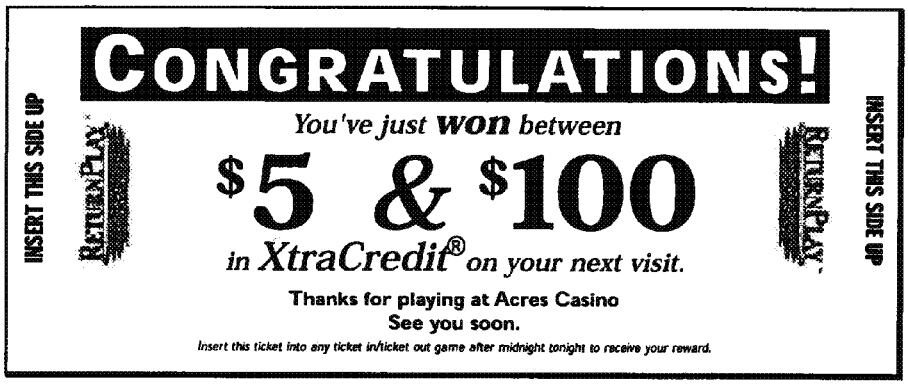
Figure 12:
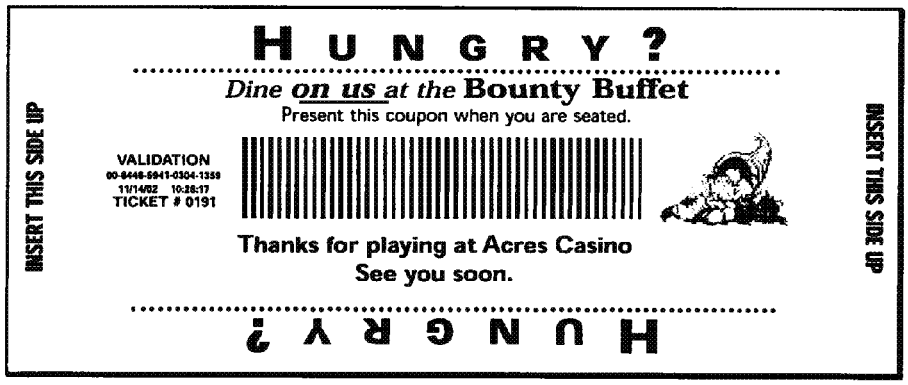
Figure 13:
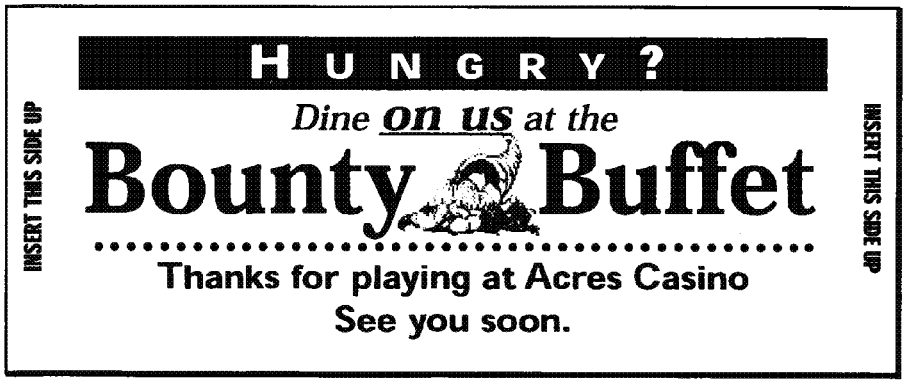

Some of the tickets, for instance those illustrated in FIGS. 8, 10, and 12, include a barcode printed directly on the ticket. The barcode may identify the particular singular ticket, or the type of ticket generated. If applicable, the player may redeem the printed ticket by inserting the ticket into the bill acceptor 20 of the gaming device 10 (FIG. 1). The bill acceptor can check the data record stored on the player database 142 for the particular identified player to determine if the player is eligible to receive such an award. If eligible, the player's record is updated to reflect that the award has been redeemed. This prevents unauthorized use of awards, such as by transferring awards to players not eligible to receive them or copying another's award.

Thus, although particular embodiments for a promotion system including a ticket printer have been discussed, it is not intended that such specific references be considered as limitations upon the scope of this invention, but rather the scope is determined by the following claims and their equivalents.

What is claimed is:

1. A gaming machine award system, comprising:

a plurality of gaming devices coupled over a network;

an award server coupled to the network, the award server including non-player specific parameters and the award server configured to implement a procedure for making an award in excess of any award established by a pay table of a gaming device in the network based on the non-player specific parameters, wherein the non-player specific parameters are award types or trigger conditions associated with an unidentified player;

a player tracking device configured to determine an identity of a player at a selected gaming device;

a player database configured to store player tracking data associated with an identified player;

a game play tracker configured to track game play across the network of gaming devices and detect a trigger condition by accessing data on the network, said award server configured to send out a selection signal over the network to the selected gaming device responsive to the detected trigger condition to provide an award at the selected gaming device, in excess of any award established by a pay table of the selected gaming device, wherein the type of award or trigger condition is based on whether the identity of the player is known or not and wherein the non-player specific parameters in the award server are overwritten if there is player tracking data associated with an identified player stored in the player database such that the award or trigger condition is based on the identity of the player; and a printer associated with the selected gaming device, said printer structured to generate printed output indicating said award responsive to receipt of said selection signal, said printer including a first port configured to receive, from game electronics of the selected gaming device, cash data indicative of information to be printed on a voucher and a second port configured to receive said selection signal from said award server for printing of said printed output.

2. The gaming machine award system of claim 1, wherein said printed output is a ticket having printed indicia on the ticket indicating said award and printed electronic identification associated with said printed indicia in a database coupled to the gaming network.

3. The gaming machine award system of claim 2, further including a ticket reader at each of the gaming devices adapted to read said printed electronic identification and redeem said award at said gaming device.

4. The gaming machine award system of claim 3, further including a validator configured to be used to add credits to a player account balance responsive to an insertion of the ticket into the ticket reader.

5. The gaming machine award system of claim 4, wherein the credits are redeemable.

6. The gaming machine award system of claim 4, wherein the credits can be used to reimburse a played wager.

7. The gaming machine award system of claim 4, wherein the credits can be used to play a game.

8. A method for printing tickets at gaming devices that are interconnected by a gaming network to a host computer, the method comprising:

using data accessible in the gaming network to create a trigger condition;

storing said trigger condition and non-player specific parameters for making an award in excess of any award established by a pay table of a gaming device in the network at the host computer, wherein the non-player specific parameters are award types associated with an unidentified player;

tracking game play across the network of gaming devices;

determining whether an identity of a player at a selected gaming device is known;

storing player tracking data associated with an identified player in a player database;

detecting said trigger condition and sending out a selection signal over the network to the selected gaming device responsive to the detected trigger condition, to provide an award at the selected gaming device not based on a pay table of a gaming device in the gaming network, wherein the type of award or trigger condition is based on whether the identity of the player is known or not and wherein the non-player specific parameters in the host computer are overwritten if there is player tracking data associated with an identified player stored in the player database such that the award or trigger condition is based on the identity of the player; and generating printed output indicating said award responsive to receipt of said selection signal at a first port of a printer and generating a printed voucher indicative of cash data responsive to receipt of a signal from game electronics of the selected gaming device at a second port of said printer.

9. The method of claim 8, wherein generating printed output comprises generating a ticket at the selected gaming device.

10. The method of claim 8, further including accepting the printed output at a gaming device and awarding a bonus associated with said printed output.

11. The method of claim 10, where awarding a bonus comprises applying credits to a player account at the selected gaming device.

12. The method of claim 10, where awarding a bonus comprises applying credits to a playable-only credits meter at the selected gaming device.

13. The method of claim 10, where awarding a bonus comprises applying credits to a player account only if the printed output was accepted at the gaming device within a redeemable time period.

14. The method of claim 13, wherein the redeemable time period includes a preestablished start time that occurs after a time at which the printed matter was generated at the selected gaming device.

15. A gaming device award system, comprising:

a plurality of gaming devices coupled over a network;

an award server coupled to the network, the award server including non-player specific parameters and the award server configured to implement a procedure for making an award in excess of any award established by a pay table of a gaming device in the network based on the non-player specific parameters, wherein the non-player specific parameters are award types or trigger conditions associated with an unidentified player;

a player tracking device configured to determine an identity of a player at a selected gaming device;

a player database configured to store player tracking data associated with an identified player;

a game play tracker configured and arranged to track game play across the network of gaming devices and to detect a trigger condition created using data accessible in the gaming network wherein a selection signal is provided at the selected gaming device in response to the detected trigger condition to provide an award at the selected gaming device, in excess of any award established by a pay table of a gaming device in the network, wherein the type of award or trigger condition is based on whether the identity of the player is known or not and wherein the non-player specific parameters in the award server are overwritten if there is player tracking data associated with an identified player stored in the player database such that the award or trigger condition is based on the identity of the player; and a printer associated with the selected gaming device, the printer structured to generate printed output responsive to receipt of the selection signal to indicate the award, said printer including a first port configured to receive, from game electronics of the selected gaming device, cash data indicative of information to be printed on a voucher and a second port configured to receive the selection signal for printing of said printed output.

* * * * *